US005954379A

United States Patent [19]

Pikel

[11] Patent Number: 5,954,379

[45] Date of Patent: Sep. 21, 1999

[54] SHAFTED SPORTS EQUIPMENT CARRIER

[76] Inventor: Jeffery J. Pikel, 808 E. Gump Rd., Fort Wayne, Ind. 46845

[21] Appl. No.: 09/126,678

[22] Filed: Jul. 30, 1998

[51] Int. Cl.[6] ..... A45F 5/00; B65D 71/00

[52] U.S. Cl. ..... 294/159; 294/166; 294/170

[58] Field of Search ..... 294/15, 16, 33, 294/137, 147, 148, 160, 166, 170, 159; 224/916, 917, 922; 206/315.2, 315.11, 443; 211/60.1, 70.2, 70.5, 70.8

[56] References Cited

U.S. PATENT DOCUMENTS

| | | | |
|---|---|---|---|
| D. 338,048 | 8/1993 | Finley . | |
| 2,816,696 | 12/1957 | Stockfleth | 294/159 |
| 3,591,063 | 7/1971 | Pearce | 294/137 |
| 3,626,553 | 12/1971 | Darney et al. | 294/147 |
| 3,880,336 | 4/1975 | Demasson . | |
| 4,059,209 | 11/1977 | Grisel | 294/147 |
| 4,134,182 | 1/1979 | Ramsby | 294/147 |
| 4,193,495 | 3/1980 | Keeley | 211/60.1 |
| 4,331,357 | 5/1982 | Contreras | 294/159 |
| 4,699,415 | 10/1987 | Skovajsa . | |
| 4,871,102 | 10/1989 | Wickersham . | |
| 5,154,467 | 10/1992 | Lanius et al. | 294/160 |
| 5,249,723 | 10/1993 | Lamadelein . | |

*Primary Examiner*—Dean J. Kramer

*Attorney, Agent, or Firm*—Susan L. Firestone; Paul W. O'Malley

[57] ABSTRACT

The invention relates to a carrier for sports equipment having a long shaft. The carrier has a base with shaftholders at opposite ends and a handle. The shaftholders hold the shaft in place to allow the sports player to carry the shafted equipment for long distances and alter the carrier's position while reducing stress on the wrist.

14 Claims, 4 Drawing Sheets

FIG. 1
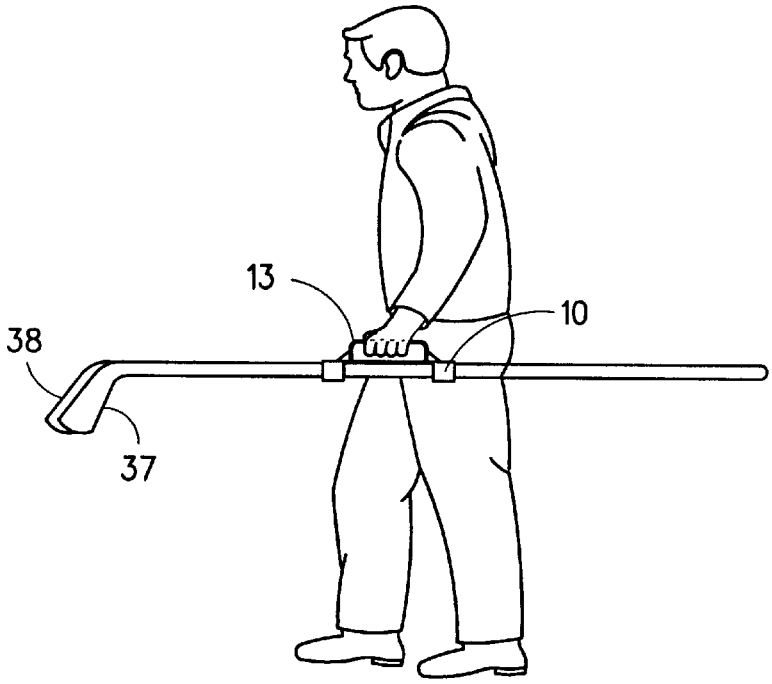
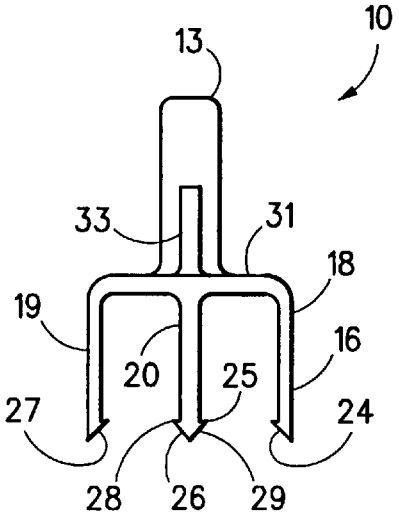
FIG. 5
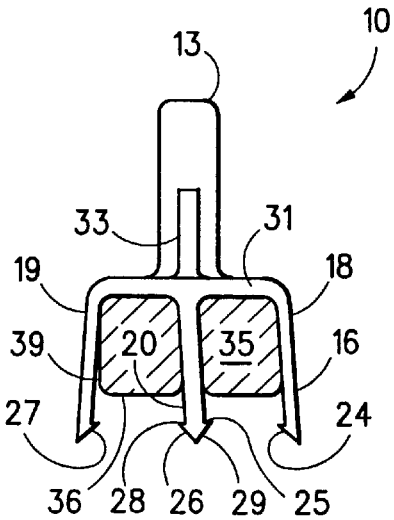
FIG. 6

SHAFTED SPORTS EQUIPMENT CARRIER

BACKGROUND OF THE INVENTION

1. Field of the Invention

The present invention relates to a carrier for long, shafted sports equipment and more particularly to a hand held carrier.

2. Description of the Prior Art

Long, shafted, sports equipment is awkward to carry. Ice hockey sticks, for example, are typically more than four feet long. Because hockey sticks can break or crack during use, players often carry at least two sticks.

It is fatiguing and uncomfortable to carry long shafted equipment vertically or unbalanced for long distances, such as from a car in a parking lot to an arena or playing field. Carrying long shafted equipment, such as hockey sticks, vertically or unbalanced locks the wrist in a flexed position, which over time is fatiguing and uncomfortable. If the player grasps the sticks away from their center of gravity, the unbalanced sticks flex the wrist away from a neutral position. Furthermore, the sticks' center of gravity concentrates the weight on the flexed wrist which additionally stresses the wrist.

Carrying hockey sticks horizontally stresses the wrist less. When carrying the sticks horizontally, however, they jut out several feet in front and behind the player. In order to open doors and walk through doorways or narrow corridors to the locker room, the player must tip the sticks vertically. Similarly if the doorway or corridor is crowded, the user must tip the sticks to avoid striking others.

Players usually carry more than just sports sticks. Players must carry the sticks and all of the requisite gear associated with their particular sport. The player's gear usually comprises bulky additional equipment, such as protective padding, uniforms, skates or shoes, helmets, pucks or balls, and the like. During winter, in northern climates where ice hockey is popular, the player may also struggle with heavy winter clothing, boots and gloves. The player carries all of this gear from the parking lot into the ice arena and to the locker room, often over long distances and in one trip.

An additional problem is designing a carrier that a player can easily insert and remove the shafted stick. Carriers with long locking portions are cumbersome when inserting and removing the shaft of the stick. The sidewalls of the carrier must be forced apart to insert the shaft, often requiring both hands to lock the stick into place. Because more of the shaft is locked into the carrier, the shaft will not release as readily from the carrier, again requiring the use of two hands to force apart the sidewalls. These steps become more difficult in colder weather, when hands are cold and stiff and possibly gloved.

U.S. Pat. No. 5,249,723 discloses a carrier for sports equipment with elongated shafts, particularly hockey sticks. The carrier of the '723 patent retains hockey sticks in elongated, downwardly open, U-shaped channels. The '723 carrier is worn over the shoulder by use of a shoulder strap. The elongated channels are formed by first (outer) sidewalls and a shared inner sidewall. The first, or outer sidewalls, angle from a base to an open mouth of the channels so that the mouth or top edge of the sidewall is closer to the inner sidewall than the portion of the sidewall adjacent the base of the carrier. The outer sidewalls have an included angle of about 86° in the preferred environment. Inserting a hockey stick forces the sidewalls apart, primarily by pushing the outer sidewall outwardly. After inserting the stick, the bias of the first sidewall pushes the sidewall against the stick to retain the stick in position. Although the angled sidewalls ensure that the shaft is held tightly in place, it increases the difficulty of inserting and removing the shaft. If the hockey stick is not centered in the carrier, the sticks will tip with no easy way to compensate for their uneven placement.

Use of a shoulder strap in the '723 patent allows the sticks to be carried horizontally, if the player properly positions the strap on the shoulder. However if the straps of an equipment bag are worn over the carrier's shoulder strap, it can displace or bind the strap in an uncomfortable or difficult to change position. Such binding can also make it more difficult to move the stick into a more vertical position without first lifting up the carrier then tipping the sticks with a free hand. If the equipment bag is not worn over the shoulder, tipping the carrier would rub the strap against the shoulder.

A carrier should provide for the easy insertion and removal by a player of the shaft of a hockey stick. The elongated channels of the '723 patent can make insertion and removal difficult due to friction from an extended area of contact between the shaft and sidewalls and due the angled unbiased orientation of the first sidewalls. The '723 patent appears to contemplate that the sidewalls of the carrier must be forced apart before insertion or extraction of a shaft. This appears to require the use of both hands just to manipulate the carrier, leaving no hand conveniently free to actually position the stick. This sort of manipulation of the carrier becomes more difficult in colder weather, when hands are cold and stiff and possibly gloved.

Carrying hockey sticks horizontally, with the wrist hanging unflexed from the arm, aids comfort, provided the sticks do not slide apart or become crossed. It would be advantageous for a carrier to firmly position one or more sticks, and to allow the quick, positive movement of the sticks to a vertical position to fit through tight spaces and avoid hitting others. To meet these and other objectives, it is one object of the invention to provide a lightweight handheld carrier into which a player can easily insert a shaft in such a way that the stick is easily balanced in the carrier upon insertion to reduce stress on the wrist. It is another object of the invention to provide a carrier in which the shafts, or the hand, may be readily repositioned to maintain the sticks in balance to reduce the stress on the wrist. It is still another object of the invention to provide a carrier from which the shafts may be readily extracted. It is a still further object of the invention to provide a carrier which may be readily moved to reposition the shafts to a vertical or other desired orientation.

SUMMARY OF THE INVENTION

The carrier of the invention is for sports equipment with a shaft. The carrier has a base with opposite ends and means depending from the base for gripping and carrying the carrier. At the opposite ends of the base are first and second shaftholders which are aligned to jointly engage the shaft. The shaftholder has a shaftholder base.

A pair of sidewalls forms the sides of the shaftholder. The pair of sidewalls are spaced apart at a distance slightly less than or equal to the shaft's width. The sidewalls may have overhanging lips extending along the length of the sidewalls distal to the base. Each overhanging lip has a retaining ledge and a shaft guide, with the retaining ledge located a distance from the base greater than the shaft's height.

Additional effects, features and advantages will be apparent in the written description that follows.

BRIEF DESCRIPTION OF THE DRAWINGS

FIG. 1 is a perspective view showing the carrier in use;

FIG. 5 is a cross-sectional view of the invention; and

FIG. 6 is a cross-sectional view of a carrier of the invention holding two shafts.

DETAILED DESCRIPTION OF THE INVENTION

Figure 2:
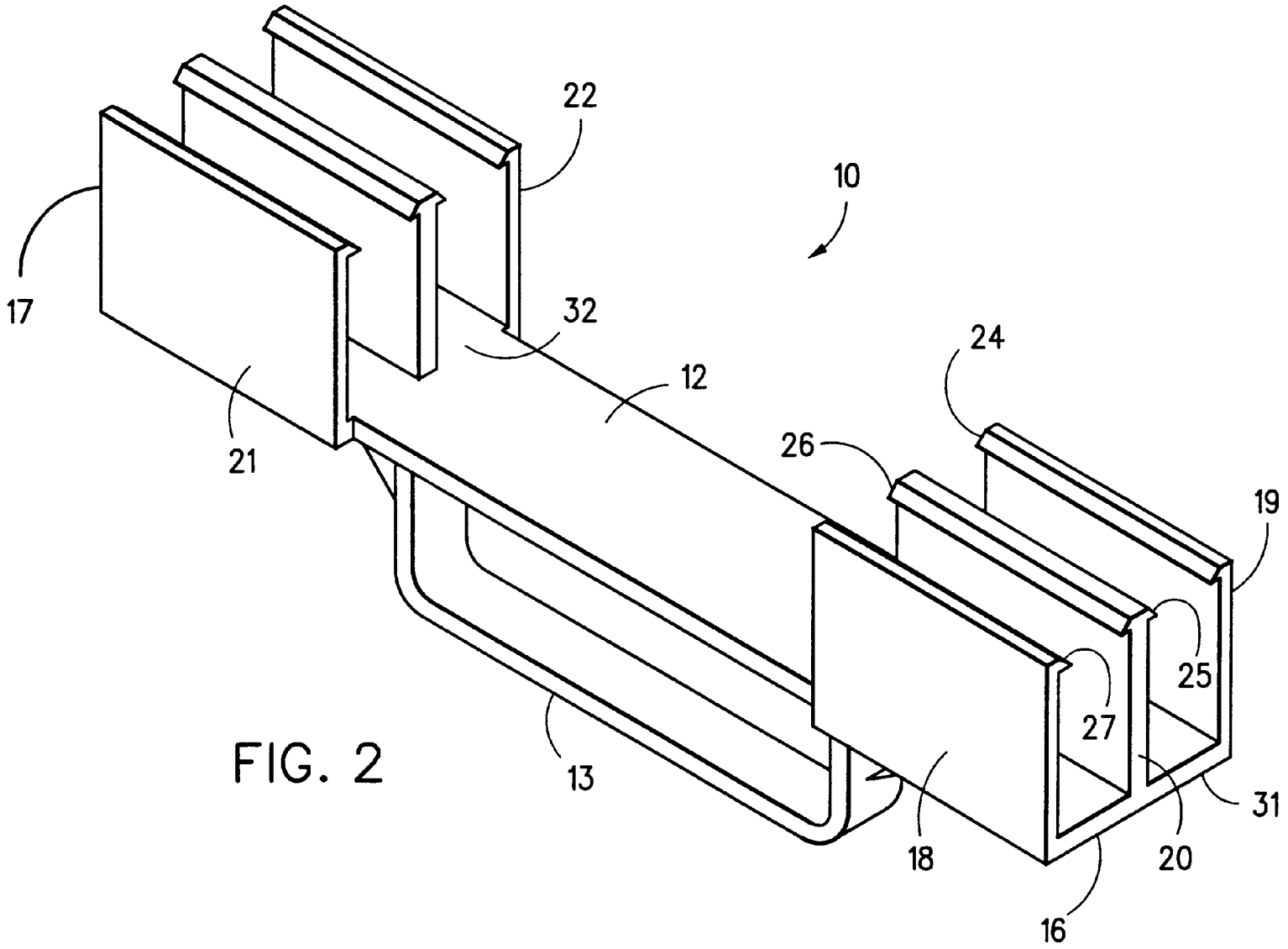
FIG. 2 is a perspective view of the carrier.
Figure 3:
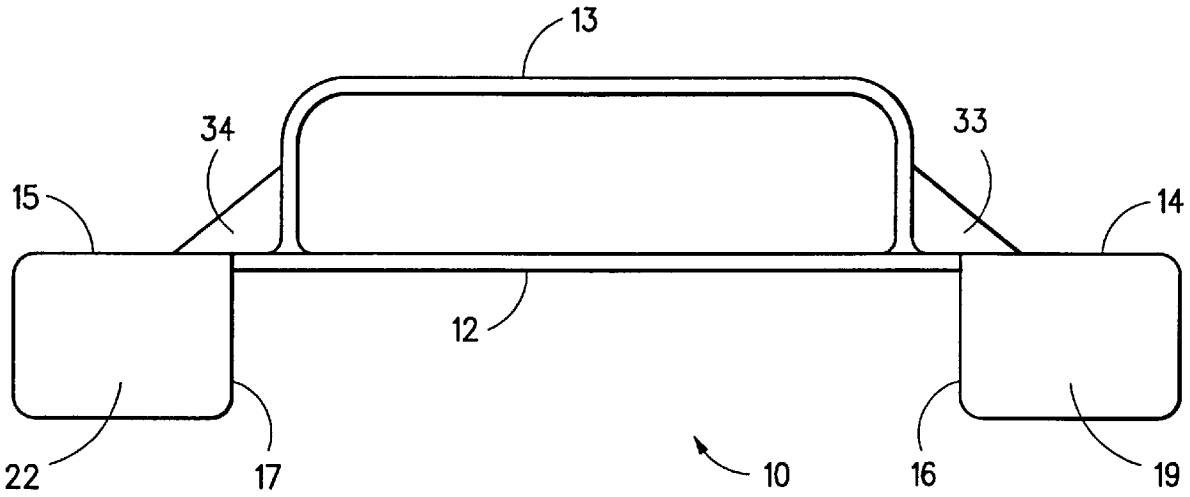
FIG. 3 is a side view of the carrier of the invention.
Figure 4:
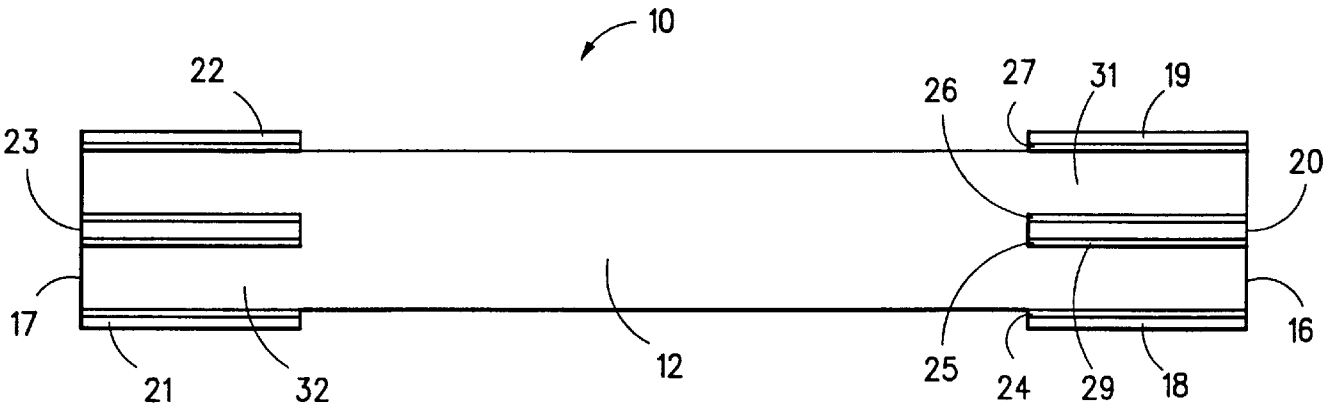
FIG. 4 is a plan view from below of the carrier of the invention.
Figure 7:
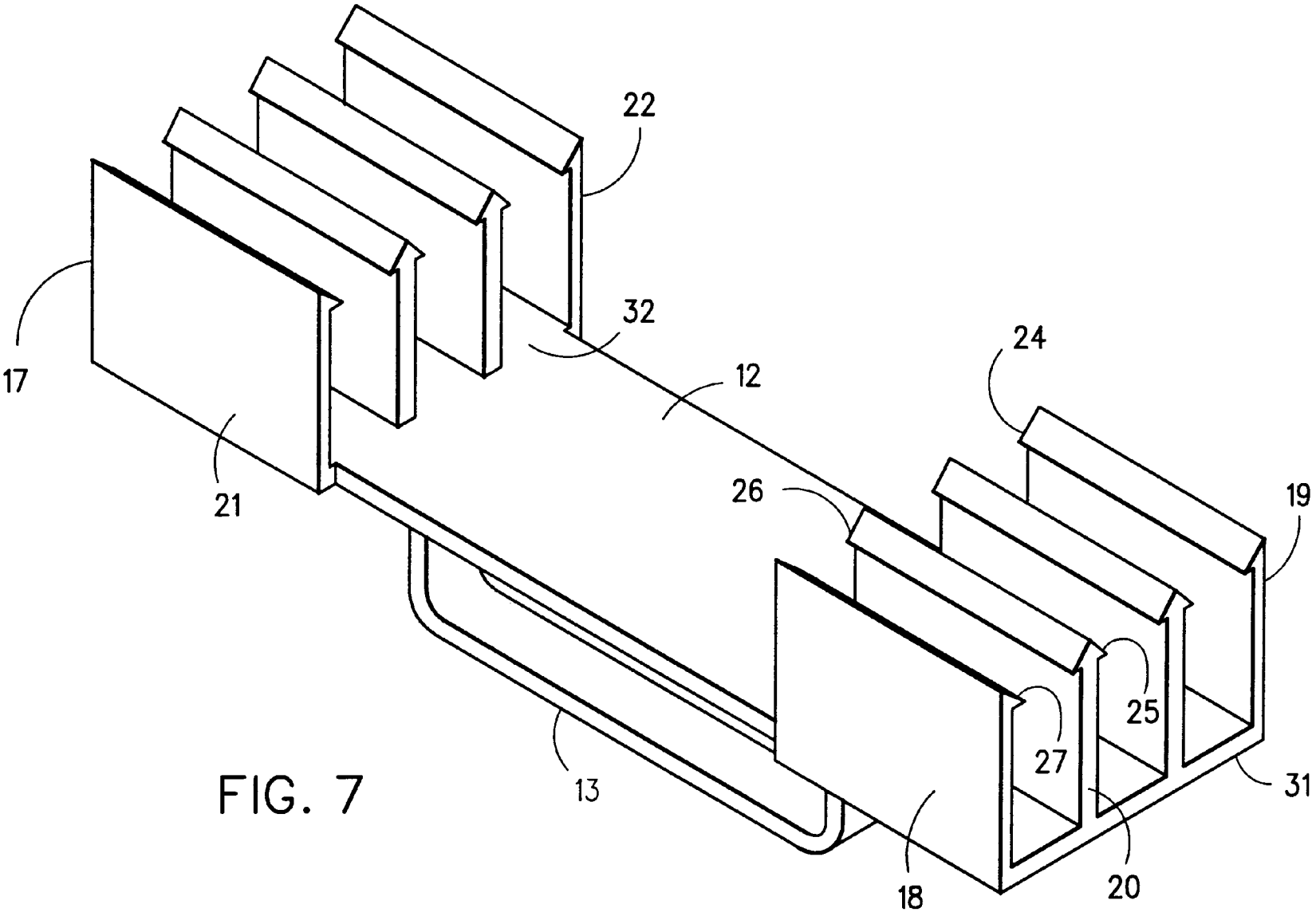
FIG. 7 is a perspective view of the carrier of the invention.

Referring now to the drawings, FIG. 1 depicts an ice hockey player carrying carrier 10 in which are positioned two ice hockey sticks 37 and 38. The player grasps handle 13 of carrier 10 with the wrist in a relaxed, unflexed position relative to a relaxed, downwardly directed arm. With the hand and wrist so positioned, hockey sticks 37 and 38 lie in a horizontal position. Hockey sticks 37 and 38 are readily balanced between two points of support (described below) on carrier 10 and/or by the player shifting his hand position on handle 13. Carrier 10 firmly retains hockey sticks 37 and 38, allowing the player quickly to move the sticks from a horizontal orientation to a vertical orientation without losing control of one of the sticks, having the sticks cross, or other difficulty encountered if the sticks were held directly.

Referring to the Figures, carrier 10 of the invention has a base 12, a handle 13 extending from the top of base 12 and shaftholders 16, 17 extending from the bottom of base 12 and spaced apart at opposite ends 14, 15. The carrier of the invention holds sports equipment with a shaft, preferably a shaft that has one flat face, more preferably a shaft with two flat faces and most preferably a rectangular shaft.

Shaftholders 16, 17 have outer sidewalls 18, 19, 21, 22 and inner sidewalls 20, 23, respectively, located between outer sidewalls 18, 19 of shaftholder 16 or outer sidewalls 21, 22 of shaftholder 17. Each sidewall extends outwardly from shaftholder base 31, 32 which may be part of base 12 or separately attached to base 12. Shaft 36 inserts between outer sidewall 19 and inner sidewall 20 of shaftholder 16 and outer sidewall 21 and inner sidewall 23 of shaftholder 17. By providing separated shaftholders 16, 17 for engaging a shaft at opposite ends 14, 15 of base 12, carrier 10 insures that an inserted shaft has at least two, spaced apart points of support. The player can easily position a shafted stick in carrier 10 by sight so that the center of gravity of the stick is between the points of support. The shaft may rest flush against the shaftholder base.

A shaft inserted into shaftholders 16 and 17 contacts the adjacent faces of the cooperating sidewalls. If the shaft is reasonably centered, it is supported on opposite sides of the center of gravity of the stick. This result is obtained notwithstanding an uneven finish to the faces of the sidewalls, or to the shafts of the sticks. The sidewalls, particularly the outer sidewalls 19, 21 of shaftholders 16 and 17, can flex independently under the mechanical stress of introducing a shaft to allow each sidewall to make independent clean contact with the sticks as described below.

The spacing from outer sidewall 18 to inner sidewall 20 allows the sidewalls to cooperatively hold shaft 36 in position while resisting the free forward and backward movement of the shaft along the carrier when shifting the position of the carrier and shaft. The sidewalls are spaced apart at a distance less than or equal to the width of the shaft, preferably less than the width of the shaft. The difference between the width of the shaft and the distance between the sidewalls at the base ranges from about 0 to about 0.1 in., preferably ranging from about 0.03 in. to about 0.065 in. For example, if a shaft has a width of about 0.81 in., the distance between the sidewalls can range from about 0.71 to about 0.81 in., preferably about 0.78 in. to about 0.73 in. with about 0.75 in. more preferred. When carrying two shafts side by side in the carrier, this spacing tightens the sidewalls' hold on the shaft to prevent the shaft from slipping when shifting position from horizontal to vertical and back again. Yet, the player simply slides the carrier up or down the shaft to change the balance of the stick in the carrier.

When the carrier is empty as shown in FIG. 5, the sidewalls are preferably substantially perpendicular to the base. When shaft 35 is in the carrier, either outer sidewall 18 and inner sidewall 20 or both are at an angle greater than 90° from base 12. When shafts 35, 36 are in the carrier as shown in FIG. 6, inner sidewall 20 is substantially perpendicular to the base, while outer sidewalls 18, 19 are deflected outwardly to an angle greater than 90° from shaftholder base 31. The sidewalls usually touch only part of the shaft's face when the shaft is in the carrier. Sidewall 19, for example, touches only part of shaft outer face 39. Furthermore, the outward angle that the sidewall assumes under pressure from the shaft makes it easier to remove the shaft from the carrier without losing the frictional contact that prevents the shaft from falling from the carrier.

Inwardly overhanging lips 24, 25, 26, 27 are located on outer sidewalls 18, 19 and inner sidewall 20 distal to shaftholder base 31. Shaft guide 29 of the lip is either sloping or curved which guides the shaft into the carrier with minimum force. The overhanging lips have a retaining ledge 28 that extends along the length of the sidewalls and is substantially parallel to shaftholder base 31. The retaining ledge prevents the shaft from slipping out of the carrier when carried in a horizontal position, especially when only one shaft is in the carrier.

The distance of the retaining ledge from the base is greater than the height of the shaft. For example, if the height of the shaft is about 1.34 in., the distance of the retaining ledge from the base can be about 1.5 in. This difference in height aids shaft removal from the carrier. When the retaining ledge is at the height of the shaft from the base, it is more difficult to remove the shaft out of the carrier.

Handle 13 extends from the top of the base 12. Handle 13 can have ribs 33, 34 extending from base 12 to handle 13. Handle 13 is permanently attached to base 12. Finger grips can be added, if desired.

Each shaftholder holds at least two shafts. The shaftholders can be adapted to hold more shafts by increasing the distance between the outer sidewalls and adding additional inner sidewalls. In the alternative, the shaftholder can be adapted to hold more shafts, especially rectangular shafts, by increasing the height of the sidewalls to fit an additional shaft above a shaft already placed between the outer and inner sidewalls.

The shaftholders preferably range in length from about 1.5 in. to about 3 in., preferably about 2 in. The shaftholders are spaced about 3 in. to about 7 in. apart, preferably about 5 in. apart. Although two shaftholders are preferred, if desired, additional shaftholders can be added to the carrier, such as at the center of the base.

The shaftholder is made from material that resists flexure or bending and is biased to return to its original shape. Although the sidewalls may shift from substantially perpendicular to the base to greater than 90° when a shaft is inserted into the carrier, the material itself neither bends nor deforms around the shaft. The sidewalls, particularly the outer sidewall and the base may act as a torsion bar spring clamping a shaft into a shaftholder. When the shaft is removed, the sidewalls regain their initial position. Suitable materials have high strength (tensile, flexural, compressive and shear) with good toughness or impact strength. Preferably, the material has a stiffness or tensile or flexural modulus greater than about 700 MPa or 100,000 psi at 23° and 50% relative humidity. Plastics, with or without fillers, such as polyamide like nylon 6 and nylon 66, and the like are suitable.

Although the base and/or handle could be made of a lightweight metal with plastic shaftholders, the whole carrier is preferably made from plastic. The base, sidewalls and handle can be made separately and affixed together by any known method, such as gluing or annealing. The carrier is preferably a unitary piece with all parts made from one mold. Plastic is preferable because it is cost effective, easy to mold, lightweight and comfortable to carry, especially in cold or hot environments. The carrier can be made by any fabrication method currently known, such as injection molding.

Although the Figures show the invention with ice hockey sticks, the carrier of the invention can hold other long shafted equipment for other sports such as field hockey, broom ball, lacrosse, and the like.

The carrier of the invention allows a player to easily place long shafted items, such as hockey sticks into the carrier. While holding a stick with one hand, a hockey player, for example, angles the shaftholder or the shaft at one end of the carrier and slides the shaft over the overhanging lips and between the outer and inner sidewalls. The shaftholder at the opposite end of the carrier readily slides into place over the shaft.

The player removes the shaft from the carrier by holding the shaft in one hand and pulling the handle of the carrier away from the shaft until it releases. The carrier of the invention allows the player to simultaneously remove both sticks at the same time by holding the sticks in one hand and pulling the handle away from the sticks with the other.

The ease of insertion and removal with the carrier of the invention has additional advantages. The player does not need to manually force the sidewalls apart to insert or remove a stick, which makes the carrier easier to use, especially when hands are sweaty or cold and stiff or gloved.

If the weight of the shaft is not evenly distributed, the player can slide the carrier along the shaft to redistribute the weight and reduce wrist fatigue. Yet, the player can vertically tip the carrier of the invention to pass through narrow passageways and doorways without the shaft slipping in the carrier.

While the invention is shown in only one of its forms, it is not thus limited but is susceptible to various changes and modifications without departing from the spirit and scope of the invention.

What is claimed is:

1. A carrier for sports equipment with a shaft comprising:

a base having opposite ends;

first and second shaftholders at opposite ends of the base on a face thereof and aligned to jointly engage the shaft;

a pair of sidewalls forming the sides of the shaftholder, each sidewall being spaced from another sidewall at a distance slightly less than or equal to the shaft's width:

a handle depending from the base;

overhanging lips extending along the length of the sidewalls distal to the base, each overhanging lip having a shaft guide extending along the length of the overhanging lips; and wherein the handle extends from a second face of the carrier opposite the face from which the shaftholders extend.

2. A carrier of claim 1, further comprising:

a retaining ledge extending along the length of the overhanging lip adjacent to the shaft guide, the retaining ledge being located a distance from the base greater than the shaft's height.

3. A carrier of claim 1, wherein the sidewalls are spaced at a distance from about 0.03 in. to about 0.065 in. less than the width of the shaft.

4. A carrier of claim 1, wherein the angle between at least one sidewall and the base is greater than 90° when the shaft is in the carrier between the sidewalls.

5. A carrier of claim 1, further comprising:

an inner sidewall located between the pair of sidewalls forming the sides of the shaftholder; and wherein the angle between at least one sidewall and the base is greater than 90° when the shaft is in the carrier between the sidewalls.

6. A carrier of claim 1, further comprising:

an inner sidewall located between the pair of sidewalls forming the sides of the shaftholder; and wherein the sidewall and the base act as a spring to clamp the shaft into the shaftholder.

7. A carrier for sports equipment with a shaft, comprising:

a base having opposite ends;

first and second shaftholders at opposite ends of the base on a face thereof and aligned to jointly engage the shaft;

a pair of sidewalls forming the sides of the shaftholder, the pair of sidewalls being spaced apart at a distance slightly less than or equal to the shafts width;

a handle depending from the base; and wherein the sidewall and the base act as a spring to clamp the shaft into the shaftholder.

8. A carrier for sports equipment with a shaft comprising:

a base having opposite ends;

first and second shaftholders spaced apart at opposite ends of the base on a face thereof and aligned to jointly engage the shaft;

each shaftholder having a pair of outer sidewalls and an inner sidewall located between the outer sidewalls, each sidewall being spaced from another sidewall at a distance less than or equal to the shaft's width at the base;

a handle extending from the base on a face thereof opposite the shaftholders; and overhanging lips extending along the length of the sidewalls distal to the base, each overhanging lip having a shaft guide extending along the length of the overhanging lips.

9. A carrier of claim 8, further comprising:

a retaining ledge extending along the length of the overhanging lip adjacent to the shaft guide, the retaining ledge being located a distance from the base greater than the shaft's height.

10. A carrier of claim 9, wherein the sidewalls are spaced at a distance from about 0.03 in. to about 0.065 in. less than the width of the shaft.

11. A carrier of claim 8, wherein each shaftholder has a plurality of inner sidewalls.

12. A carrier for sports equipment with a shaft, comprising:

a base having opposite ends;

first and second shaftholders at opposite ends of the base on a face thereof and aligned to jointly engage the shaft;

a pair of sidewalls forming the sides of the shaftholder, each sidewall having a planar inner face, the planar inner face of each sidewall being spaced a distance slightly less than or equal to the shaft's width from the planar inner face of another sidewall; and a handle depending from the base.

13. A carrier of claim 12, wherein the handle extends from a second face of the carrier opposite the face from which the shaftholders extend.

14. A carrier of claim 13, further comprising:

an inner sidewall located between the pair of sidewalls forming the sides of the shaftholder.

* * * * *